United States Patent [19]

Kainuma et al.

[11] Patent Number: 4,629,362

[45] Date of Patent: Dec. 16, 1986

[54] SHIELD TUNNELING MACHINE

[75] Inventors: Norio Kainuma, Tokyo; Takashi Sakuraya, Higashiyamato; Akira Tanaka, Yokohama; Yoshio Yanagi, Chofu, all of Japan

[73] Assignees: Ishikawajima-Harima Jukogyo Kabushiki Kaisha; The Tokyo Electric Power Co., Inc., both of Tokyo, Japan

[21] Appl. No.: 758,704

[22] Filed: Jul. 25, 1985

[30] Foreign Application Priority Data

Jun. 7, 1984 [JP] Japan ..... 59-115559
Jun. 7, 1984 [JP] Japan ..... 59-115560
Jun. 7, 1984 [JP] Japan ..... 59-115562

[51] Int. Cl.[4] ..... E21D 9/06; E21D 11/08
[52] U.S. Cl. ..... 405/146; 405/153
[58] Field of Search ..... 405/141, 142, 146, 148, 405/150, 288, 153; 299/11, 33

[56] References Cited

U.S. PATENT DOCUMENTS 3,075,359 1/1963 Clark ..... 405/146
3,678,694 7/1972 Haspert ..... 405/146
4,505,622 3/1985 Asszonyi et al. ..... 405/288

*Primary Examiner*—David H. Corbin

[57] ABSTRACT

A shield tunneling machine in which a segment holding member is movable through a lifting beam in the radial direction of a shield frame so that the segment holding member holds a segment and sets it at a predetermined position in the circumferential direction of a tunnel within the shield frame; and an end balancer is pivotably connected to a base or root balancer which in turn is slidably mounted on the lifting beam so that the segment held by the segment holding member is correctly set at a predetermined position while the posture of the segment is suitably adjusted, whereby the erection and assembly of segments can be easily accomplished.

3 Claims, 12 Drawing Figures

SHIELD TUNNELING MACHINE

BACKGROUND OF THE INVENTION

The present invention relates to a shield tunneling machine and more particularly a shield tunneling machine which can suitably control the posture of a segment, whereby the segments can be easily and quickly assembled.

Segments are erected into a cut-off and reinforcing wall over the inner surface of a tunnel driven by a tunneling machine. In other words, in order to facilitate the erection of a ring of wall in a narrow tunnel, the ring is composed of a plurality of segments and such arcuate segments are assembled one by one. In general the shield tunneling machines are provided with a device (erector arm) for erecting the segments each weighing more than one ton. Such segment assembling device comprises, as shown in FIG. 1, a circular revolving ring b mounted within a shield frame a such that the circular revolving ring b can freely rotate along the inner surface of the shield frame a, a lifting beam c mounted on the circular revolving ring b such that the lifing beam c can move in the radial direction and a segment holding mechanism d mounted on the lifting beam c. In general the segment holding mechanism d is axially movable.

Therefore, the shield tunneling machine can move a segment which is held by the segment holding mechanism d to a desired place of the inner surface wall of a tunnel by the cooperation of the circular revolving ring b and the lifting beam c.

The conventional shield tunneling machine can move a segment in the circumferential, radial and axial directions of the shield frame a, but cannot adjust the posture of the segment and/or to assemble the segment with the partially assembled ring of segments. Therefore, if the segment which has been moved to the partially assembled ring is inclined at an angle relative to the partially assembled ring, a few workers must manually make a fine adjustment. As a result, the erection of a segment is very troublesome. Furthermore, the assembled segments are manually linked by bolts. As a result, the erection of segments become further troublesome. Furthermore, since the handling and assembly of heavy segments is made in a narrow tunnel, it requires many workers and is dangerous. As a consequence, the tunnel construction costs are considerably increased.

The present invention was made to overcome the above and other problems encountered in the conventional shield tunneling machines and has for its object to provide a shield tunneling machine which can suitably control the posture of a segment and can automatically link a segment to the partially assembled ring of segments, whereby the erection and assembly of segments can be accomplished easily and quickly and the tunnel construction costs can be reduced.

The effects, features and advantages of the present invention will become more apparent from the following description of preferred embodiments thereof taken in conjunction with the accompanying drawings.

DETAILED DESCRIPTION OF THE PREFERRED EMBODIMENTS

Figure 3:
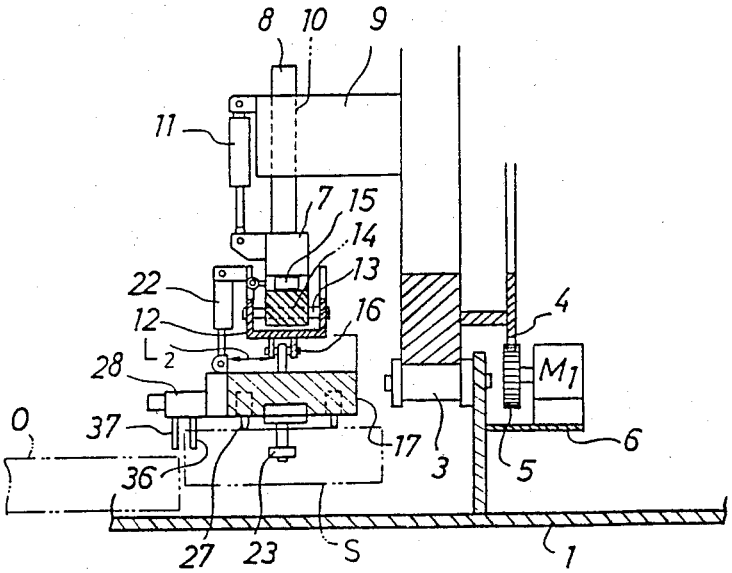
FIG. 3 is a sectional view taken along the line III—III of FIG. 2.
Figure 2:
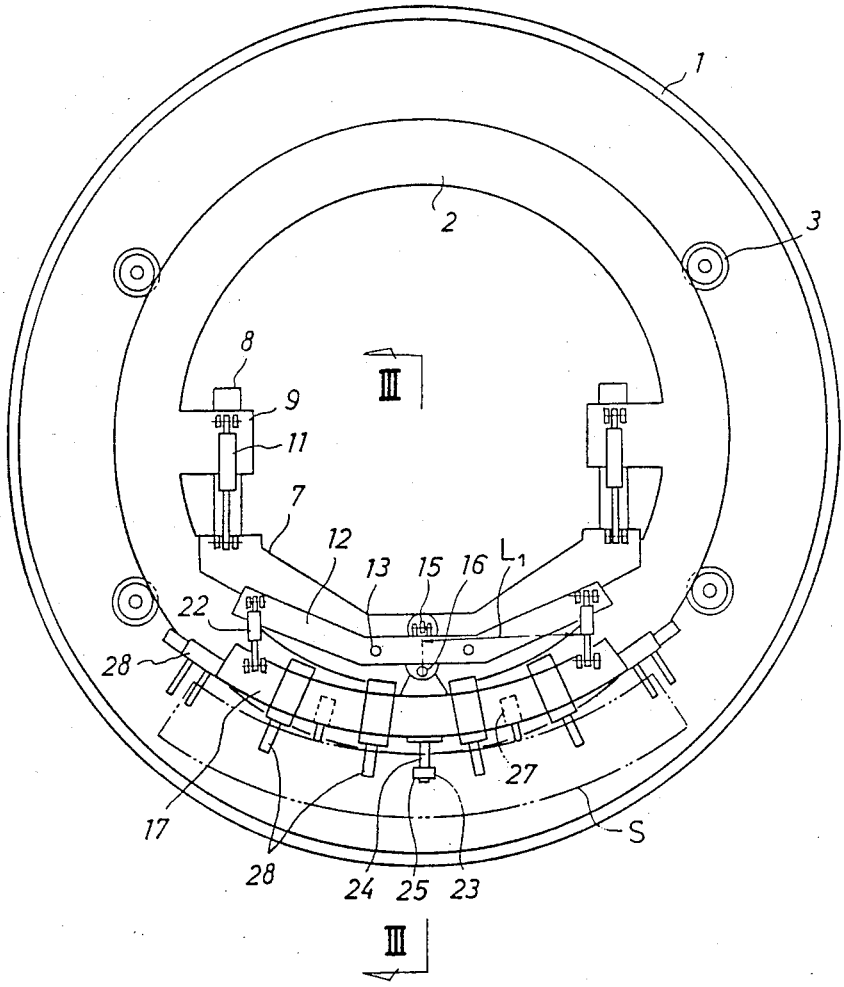
FIG. 2 is a rear view of a first embodiment of a shield tunneling machine in accordance with the present invention.

As shown in FIGS. 2 and 3, a shield tunneling machine in accordance with the present invention has a cylindrical shield frame 1 forming an outer shell of the tunneling machine and a circular revolving ring 2 is disposed within the frame 1 such that the ring 2 is supported by supporting rollers 3 and is freely revolvable or rotatable. A gear 4 is mounted on the front surface of the revolving ring 2 coaxially thereof and is in mesh with a pinion 5 which in turn is carried by the drive shaft of a motor $M_1$ mounted on a bracket 6 extending from the shield frame 1.

An arch-shaped lifting beam 7 is disposed on and along the rear side of the shield frame 1 such that the beam 7 can be freely moved in the radial direction by means of guide rods 8 and supporting arms 9. The guide rods 8 extend uprightly from the ends, respectively, of the lifting beam 7 and are slidably fitted into guide holes 10, respectively, of the supporting arms 9 extending from the revolving ring 2. Expansion cylinders 11 are interconnected between the supporting arms 9 and the lifting beam 7 so that the lifting beam 7 is radially movable.

A base or root balancer 12 which is in the form of an arc and is slightly smaller than the lifting beam 7 is mounted on the lifting beam 7 such that the base balancer 12 can slide in the axial direction of the shield frame 1 along a pair of guide bars 13. The base balancer 12 has a U-shaped cross sectional configuration and the guide bars 13 are attached to the base balancer 12 and slidably fitted into guide holes 14 of the lifting beam 7. In order to slide the base balancer 12 in the axial direction, a sliding cylinder 15 is mounted on the lifting beam 7.

Figure 1:
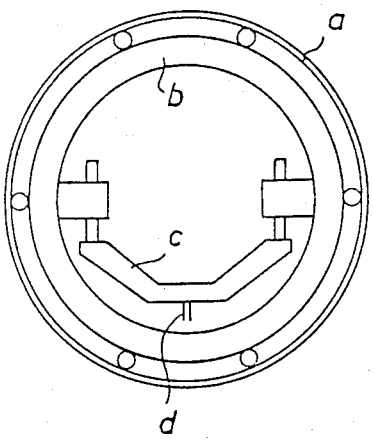
Fig.1 PRIOR ART
FIG. 1 is a rear view of a prior art shield tunneling machine.
Figure 4:
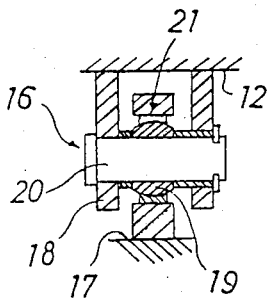
FIG. 4 is a sectional view, on enlarged scale, of a ball-and-socket joint for interconnecting a root balancer and an end balancer of the shield tunneling machine shown in FIG. 2.

An end balancer 17 is disposed outwardly of the base balancer 12 and is joined thereto through a ball-and-socket joint 16. As best shown in FIG. 4, the joint 16 comprises a shaft 20 which is supported horizontally by brackets 18 depending from the base balancer 12 and has a partially spherical head portion or inner race 19, and an outer race 21 which has a partially spherical recess into which is slidably fitted the inner race 19. The outer race 21 is securely attached to the inner surface of the end balancer 17.

The end balancer 17 is moved about the ball-and-socket bearing 16 in the axial direction of the shield frame 1 (this movement is referred to as "pitching" hereinafter in this specification) and is also moved in the circumferential direction of the shield frame 1 (this movement is referred to as "rolling" hereinafter in this specification) so that the posture of the end balancer 17 is adjusted. To this end, two posture-adjustment cylinders 22 are interconnected between the base balancer 12 and the end balancer 17 and are spaced apart radially outwardly from the ball-and-socket bearing 16 by a distance $L_1$. Therefore, when both the cylinders 22 are extended or retracted, the end balancer 17 is caused to pitch, but when the cylinders 22 are alternately extended or retracted, the end balancer 17 is caused to roll.

Figure 5:
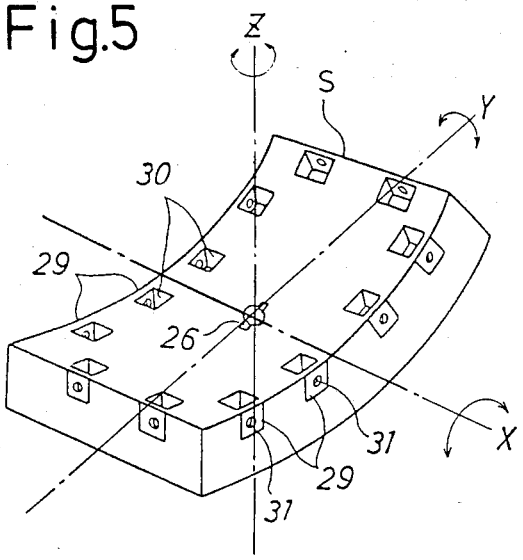
FIG. 5 is a perspective view of a segment which is handled by the shield tunneling machine in accordance with the present invention.
Figure 6:
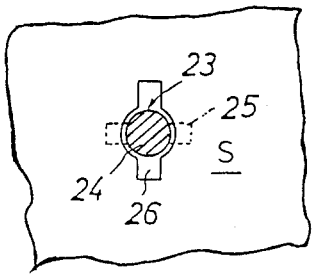
FIG. 6 is a view showing the relationship between an engaging hole of the segment and a holding member.

A holding member 23 which is adapted to releasably hold the segment S extends downwardly from the center of the outer surface of the end balancer 17. The segment holding member 23 comprises a rotary shaft 24 which extends radially outwardly from the end balancer 17, and a T-shaped hook portion formed at the leading end of the shaft 24. The holding member 23 is fitted into an engaging hole 26 at the center of the inner surface of the segment S. The holding member 23 is engaged with the segment S when the rotary shaft 24 is rotated through 90° and is disengaged from the engaging hole 26 when the rotary shaft 24 is rotated back through 90° as best shown in FIGS. 5 and 6. In order to effect the automatic engagement with and disengagement from the engaging hole 26, the rotary shaft 24 is connected to a motor (not shown).

Mounted on the end balancer 17 are plurality of support jacks 27 which are adapted to extend beyond the outer surface of the end balancer 17 so as to be firmly pressed against the inner surface of the segment S, whereby the segment S which is held by the holding member 23 is further securely supported.

The end balancer 17 is further provided with a plurality of devices 28 for tightening bolts (to be referred to as "bolt-tightening devices" hereinafter in this specification) which are used to link the segment S to a segment O which has been already erected or assembled.

Referring next to FIG. 5, the segment S is formed with a plurality of bolt-linkage flanges 29 on the peripheral surfaces thereof and a plurality of flange holes 30 which define respective bolt-linkage flanges 29 are opened at the inner surface of the segment S and are spaced apart from each other by a suitable distance. A bolt hole 31 is formed through each flange 29. In order to simplify the insertion of bolts 34 and nuts 32 into the bolt holes 31, the flanged nut 32 is rotatably mounted on one (29*a*) of the flanges to be joined with its flange portion 32*a* being engaged with a flange shoe 33 on the flange 29*a* while the bolt 34 is inserted into the flange hole 30 defined by the other flange 29*b* and is supported by a bolt supporting means 35 comprising leaf springs such that the tip of the bolt 34 is in line with the bolt hole 31 of the flange 29*b* (See FIG. 7). It is preferable that the nut 32 is attached to the flange 29*a* of the erected segment O in the manner described above because of the relationship with the bolt-tightening device 28.

Each of the bolt-tightening devices 28 has an arm 36 adapted to be inserted into the flange hole 30 to engage with the head 34*a* of the bolt 34 so that the bolt 34 is pushed toward the nut 32 for engagement therewith against the sprining force of the bolt supporting means 35 and a nut arm 37 adapted to be inserted into the flange hole 30 to engage with the nut 32 so as to rotate the same. A guide bar 38 which extends horizontally from the upper end portion of the nut arm 37 is slidably fitted into a guide hole formed at the upper portion the of the bolt arm 36 so that the bolt arm 36 is slidable along the guide bar 38. A jack 39 is mounted on the upper end portion of the nut arm 37 so that the bolt arm 36 is moved toward or away from the nut arm 37. A rotary socket 40 which is adapted to engage with the nut 32 for rotation of the same is rotatably attached to the lower portion of the nut arm 37. A motor $M_2$ is mounted on the upper portion of the nut arm 37 and an endless chain 43 interconnects between a sprocket wheel 41 carried by the drive shaft of the motor $M_2$ and a sprocket 42 attached to the rotary socket 40 so that upon energization of the motor $M_2$ the rotary socket 40 is rotated. Such bolt-tightening devices 28 are disposed on the end balancer 17 at the positions in opposed relationship with the flange holes 30 of the segments S and O. The right end of the guide bar 38 of the bolt-tightening device 28 is connected to a jack 44 which in turn is mounted on the end balancer 17 so that when the jack 44 is extended or retracted, the rotary socket 40 is moved away from or toward the nut 32.

Next the mode of operation of the first embodiment with the above-described construction will be described. First, the end balancer 17 is moved toward the segment S with the engaging hole 26 directed upward and the segment holding member or hook 23 is inserted into the engaging hole 26 of the segment S and is rotated through 90° so that the segment holding member 23 is firmly engaged with the segment S. Thereafter the segment S is lifted while the supporting jacks 27 are extended and pressed against the inner surface of the segment S so that the segment S is securely held in position. The lifted segment S is transferred to a position where the segment S is linked with the erected segment O, by rotating the revolving ring 2, moving the lifting beam 7 in the radial direction and moving the base balancer 12 in the axial direction. It may of course occur that the segment S is not correctly brought to the predetermined position or the transferred segment S is not correctly aligned with the erected segment O. In this case, the misalignment in the X direction (See FIG. 5) is eliminated by the movement in the axial direction of the base blancer 12 caused by the cylinder 15 while the misalignment in the Y direction (See FIG. 5) is eliminated by the rotation of the revolving ring 2. The misaligmnent in the Z direcion (See FIG. 5) is eliminated by the radial movement of the lifting beam 7 caused by the cylinder 11. Furthermore, the deviation of rotation about the X-axis is eliminated by causing one of the posture-adjustment cylinders 22 to extend while causing the other cylinder 22 to retract. Moreover, the deviation of rotation about the Y-axis can be eliminated by causing both the posture-adjustment cylinders 22 to extend or retract simultaneously. The deviation of rotation about the Z-axis is eliminated because when the segment S is abutted against the erected segment O, the segment S is caused to rotate about ball-and-socket joint. Thus the posture of the segment S can be freely and suitably adjusted so that the erection of the segment S can be easily and quickly accomplished.

After the segment S is brought to the predetermined position and correctly aligned with the erected segment O in the manner described above, the segment S and O are linked with each other by bolts 34 and nuts 33. In this case, the bolt arm 36 and the nut arm 37 of the bolt-tightening device 28 have been inserted into the flange holes 30 of the segments S and O upon positioning of the segment S. The jacks 39 and 44 are retracted so that the rotary socket 40 is made into engagement with the nut 32 and the bolt arm 36 is made into engagement with the head 34*a* of the bolt 34. Thereafter while the bolt 34 is pushed toward the nut 32, the nut 32 is rotated. As described above, the bolt 34 is pushed toward the nut 32 by the bolt arm 36 which is caused to move to the left in FIG. 7 by the jack 39 which is retracting and the rotary socket 40 is rotated by the motor $M_2$. Alternatively, pushing of the bolt 34 toward the mating nut 32 may be stopped when they engage with each other. Thus, according to the present invention, the operation for linking the segments S and O together by bolts can be accomplished easily, safely and quickly without the need of any worker so that the assembly of segments can be accomplished easily and quickly.

Figure 8:
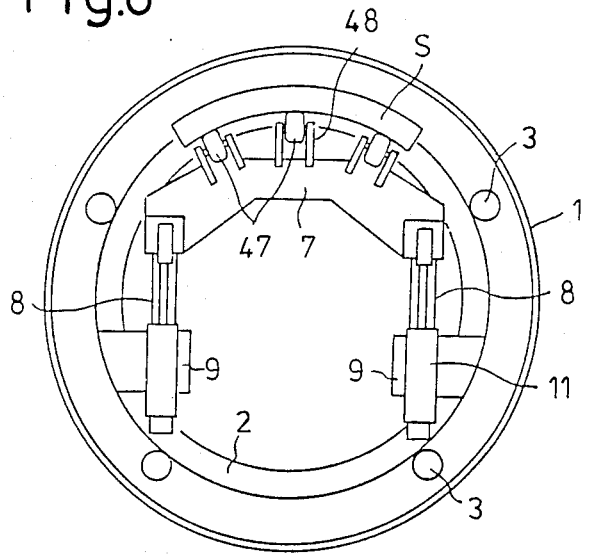
FIG. 8 is a rear view of a second embodiment of a shield tunneling machine in accordance with the present invention.
Figure 9:
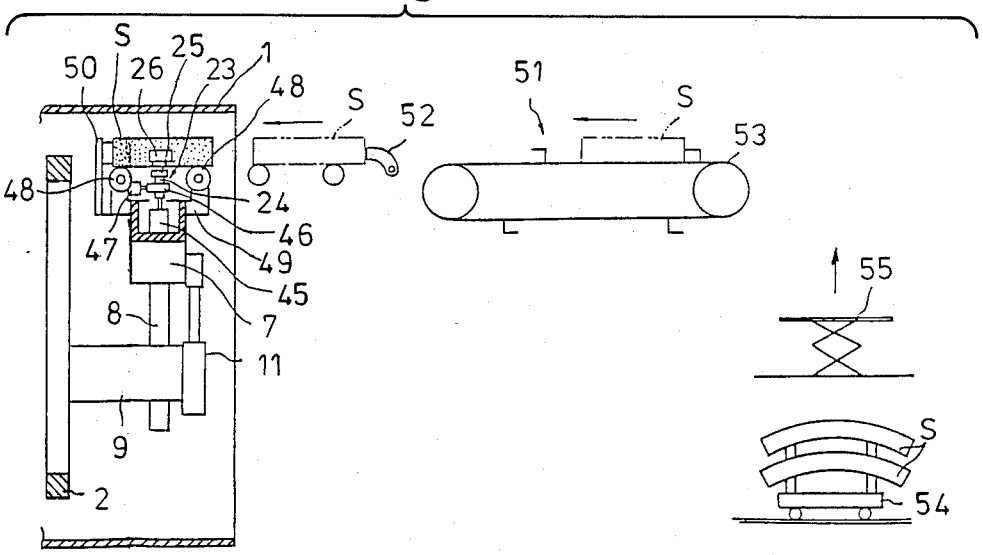
FIG. 9 is a longitudinal sectional view thereof illustrating that a segment is fed on guide rollers.

Referring next to FIGS. 8 and 9, a second embodiment of a shield tunneling machine in accordance with the present invention will be described. FIGS. 8 and 9 show that a segment S is fed and held at the top portion of a tunnel. As in the case of the first embodiment described hereinbefore, the supporting arms 9 extend inwardly from the revolving ring 2 and the lifting beam 7 is so disposed as to be movable in the radial direction along the guide rods 8. Furthermore, the cylinders 11 are interconnected between the lifting beam 7 and the supporting arms 9 so that the lifting beam 7 is moved by the cylinders 11. According to the second embodiment, the segment holding member 23 is directly attached to the lifting beam 7 and extends radially outwardly of the beam 7. That is, as described above, the segment holding member 23 comprises the rotary shaft 24 and the T-shaped hook 25 at the leading end thereof. When the segment holding member 23 is inserted into the engaging hole 26 at the center of the inner surface of the segment S and is rotated, the segment holding member 23 is firmly engaged with the segment S as shown in FIG. 6. In order to insert, rotate and release the segment holding member 23 into, in and from the engaging hole 26, a cylinder 45 is connected to the base or lower end of the rotary shaft 24 and a cylinder 47 is connected to a lever 46 which in turn is made into spline engagement with the rotary shaft 24 so that the lever 46 is slidable in the axial direction of the rotary shaft 24.

The segment S whose inner surface is directed downwardly is transferred from the tail of the shield toward the lifting beam 7 with the segment holding member 23 directed upward. Guide rollers 48 are rotatably attached to the upper ends of brackets 49 extending upwardly from the outer side wall surfaces of the lifting beam 7 so that the segment S is guided by the guide rollers 48 toward the segment holding member 23. A plurality of guide rollers 48 are provided in the circumferential and axial directions of the tunnel so that they support the inner surface of the segment S and guide it in a stabilized manner. A stopper 50 is disposed at the rear end of the lifting beam 7 so that when the segment S guided by the guide rollers 48 engages with the stopper 50, the engaging hole 26 of the segment S is in line with the rotary shaft 24 of the segment holding member 23.

A segment supply device 51 comprises a pusher 52 disposed at the upper portion of the tunnel and adapted to push the segment S toward the lifting beam 7, a conveyor system 53 disposed rearwardly of the pusher 52 for supplying a segment S onto the pusher 52, and a pantograph type lifter 55 adapted to lift a segment S carried by a carriage 54 to the level of the conveyor system 53.

Like reference numerals are used to designate similar parts throughout the figures.

Next the mode of operation of the second embodiment with the above-described construction will be described. First, the revolving ring 2 is rotated so that the lifting beam 7 is brought to the upper position as shown in FIGS. 8 and 9. When the pusher 52 of the segment supply device 51 pushes a segment S, the segment S is then supported by the guide rollers 48 and guided over the lifting beam 7 and stopped at a predetermined position when the leading end of the segment S engages with the stopper 50 as described above. Thereafter the cylinder 45 is energized so that the rotary shaft 24 is raised and inserted into the engaging hole 26 of the segment S. Then the rotary cylinder 47 is energized so that the lever 46 is rotated through 90° and consequently the rotary shaft 24 is also rotated through 90°, whereby the hook 25 engages with the engaging hole 26 in the manner described above. Next the cylinder 45 is retracted so that the inner surface of the segment S is forced to be pressed against the guide rollers 48 so that the segment S is now securely held in position. Thereafter, the revolving ring 2 is rotated and the lifting beam 7 is moved in the radial direction so that the segment S is brought to a predetermined position in the tunnel and is linked together with the segments which have been already erected and assembled in the form of a partially completed ring.

Figure 7:
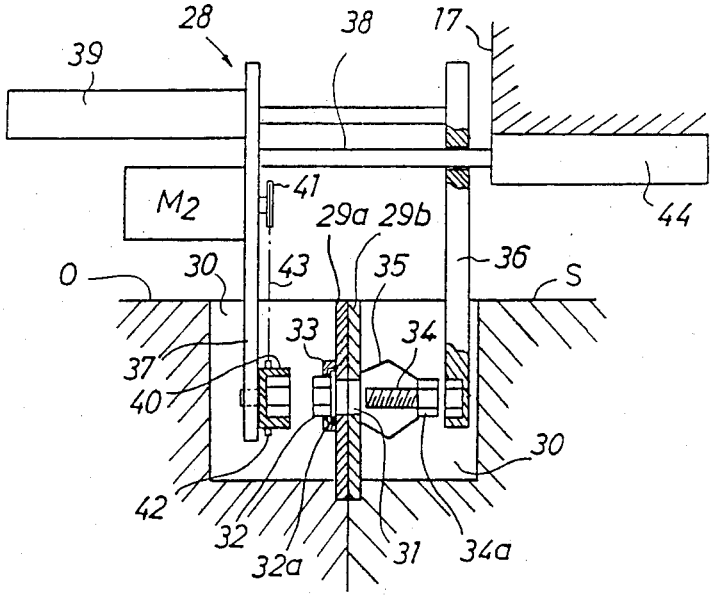
FIG. 7 is a side view of a device for tightening bolts for linking the adjacent segments.
Figure 10:
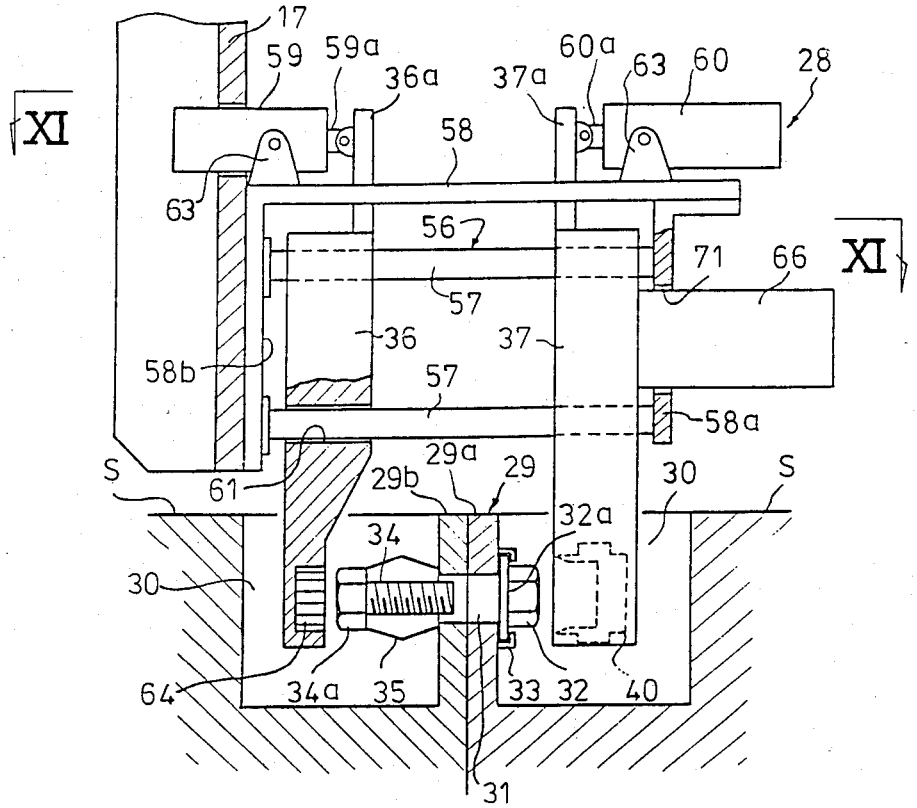
FIG. 10 is a side view of a second embodiment of a device for tightening bolts in accordance with the present invention.
Figure 11:
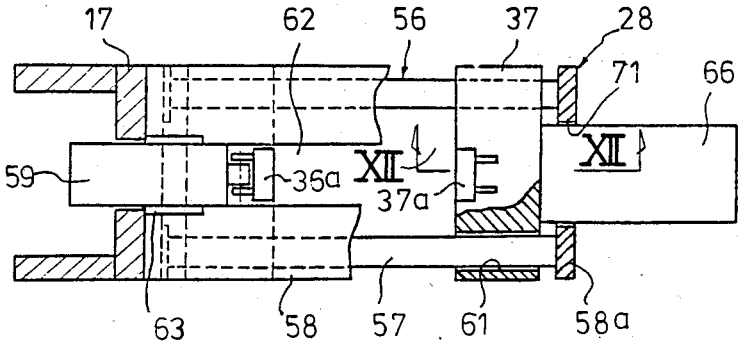
FIG. 11 is a sectional view taken along the line XI—XI of FIG. 10.
Figure 12:
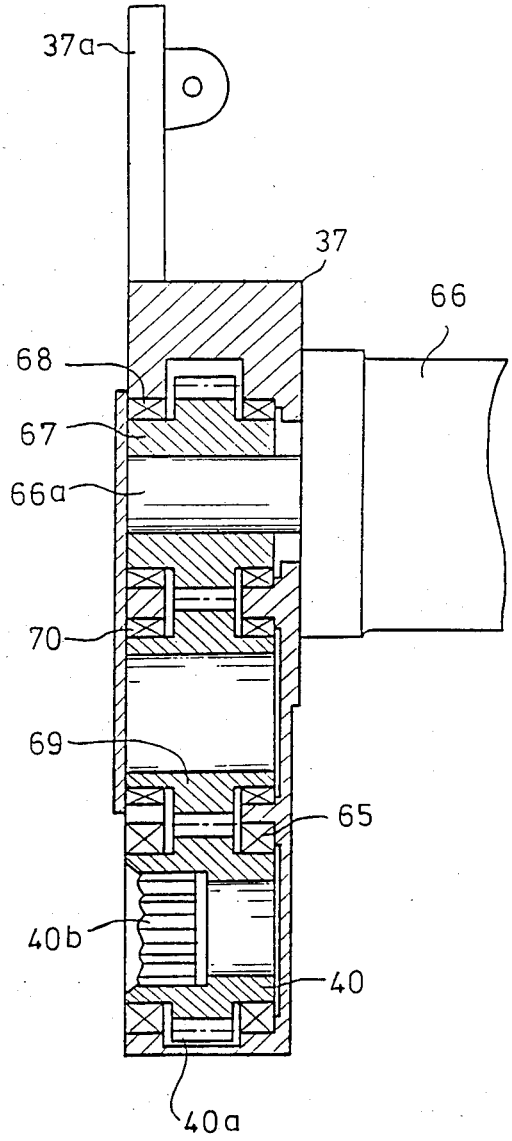
FIG. 12 is a sectional view, on enlarged scale, taken along the line XII—XII of FIG. 11.

FIGS. 10–12 shows another embodiment of a bolt-tightening device in accordance with the present invention or a modification of the bolt-tightening device as shown in FIG. 7.

The bolt-tightening device 28 is used to automatically engage a nut 32 which is rotatably attached to a shoe 33 on a flange 29*a*, with a bolt 34 which is previously disposed in a flange hole 30 and is supported by a bolt supporting means 35.

The bolt-tightening device 28 in this embodiment has the following construction and reference numerals in FIG. 7 are also used in FIGS. 10–12.

A guide frame 56 extends in parallel with the bolt 34 and spaced apart upward from the frange 29 by a suitable distance. The guide frame 56 is slidably fitted into the holes of the bolt arm 36 and the nut arm 37 so that the arms 36 and 37 can move toward or away from each other. As best shown in FIGS. 10 and 11, the guide frame 56 comprises four parallel rods 57 spaced apart from each other in the vertical and horizontal directions by a suitable distance and the ends of the rods 57 are attached to the leg portions 58*a* and 58*b*, respectively, of a mount or stand 58 upon which are mounted cylinders 59 and 60 which in turn are means for moving the arms 36 and 37, respectively. The plate-like leg portions 58*a* and 58*b* extend downwardly from the ends of the stand 58.

The arms 36 and 37 are formed with the guide holes 61 into which are slidably fitted the rods 57, respectively, and actuating rods 36*a* and 37*a* extend upwardly through the stand 58 from the upper ends, respectively, of the arms 36 and 37. Therefore, in order to permint the movement of the actuating rods 36*a* and 37*a* in the longitudinal direction of the stand 58, a longitudinally elongated guide groove 62 is formed in the stand 58. The actuating rods 36*a* and 37*a* are connected to the piston rods 59*a* and 60*a*, respectively, of the cylinders 59 and 60 mounted on the stand 58 through brackets 63 so that when the piston rods 59*a* and 60*a* are extended or retracted, the actuating rods 36*a* and 37*a* are moved in the longitudinal direction of the mount 58.

A bolt-engagement hole 64 which is adapted to releaseably engage with the head 34*a* of the bolt 34 is formed in the lower end surface of the bolt arm 36 which is in opposed relationship with the lower end portion of the nut arm 37. A socket 40 which is adapted to releasably engage with the nut 32 and to rotate the same is formed at the lower end portion of the nut arm 37 facing the bolt arm 36. As best shown in FIG. 12, the nut socket 40 comprises a driven gear with gear teeth 40*a* disposed between the outer and inner surfaces of the nut arm 37 adjacent to the lower end thereof. An engaging hole 40*b* for engagement with the nut 32 is formed in the axis of the gear. The nut arm 37 in which is mounted the nut socket 40 is in the form of a gear casing and the nut socket 40 is rotatably mounted through bearings 65 in the lower porion of the nut arm 37. A motor 66 is securely mounted on the outer surface of the nut arm 37 adjacent to the upper end thereof and a driving gear 67 is carried by the drive shaft 66*a* of the motor 66 and is rotatably disposed through bearings 68 in the upper portion of the nut arm 37. The driving gear 67 is drivingly coupled to the nut socket 40 through an intermediate gear 69 which is rotatably disposed through bearings 70 between the driving gear 67 and the nut socket 40.

The leg portion 58*a* of the stand or mount 58 is formed with a motor opening 71 in order to permit the passage of the motor 66 through the leg portion 58*a*. The leg portion 58*b* of the stand or mount 58 is securely attached to the end balancer 17.

Next the mode of operation of the second embodiment will be described. First, the bolt-tightening device 28 is moved toward the segement S so that the bolt arm 36 with the bolt-engagement hole 64 and the nut arm 37 are inserted into the flange holes 30 as best shown in FIG. 10 such that the bolt-engagement hole 64 of the bolt arm 36 is in line with the bolt 34. Thereafter the piston rods 59*a* and 60*a* of the cylinders 59 and 60 are extended so that the arms 36 and 37 are moved toward each other and the head 34*a* of the bolt 34 is fitted into the bolt-engagement hole 64 of the bolt arm 36 while the nut is fitted into the engaging hole 40*b* of the nut socket 40 of the nut arm 37. In this case, the bolt 34 is supported by the bolt supporting means 35 such that the head 34*a* of the bolt 34 snugly fits with the bolt-engagement hole 64 of the bolt arm 37. When the nut socket 40 is rotated at a slow speed and pushed toward the nut 32, it can be easily engaged with the nut 32.

Thereafter, the motor 66 is energized so that the nut socket 40 is rotated through the driving gear 67 and the intermediate gear 69 and the piston rod 59*a* of the cylinder 59 is extended so that the bolt 34 is moved toward the nut 32 in the axial direction of the bolt 34 against the force of the bolt supporting means 35. As a result, the bolt 34 is threadably engaged with the nut 32 and consequently the adjacent segments S are linked together by the bolts 34 nuts 32 which are tightened with a suitable tightening torque. After the bolt 34 and the nut 32 are engaged with each other in the manner described above, the motor 66 is de-energized and the piston rods 59*a* and 60*a* of the cylinders 59 and 60 are retracted so that the arms 36 and 37 are moved away from each other and the head 34*a* of the bolt 34 is released from the bolt-engagement hole 64 of the bolt arm 36 while the nut 32 is released from the nut socket 40 of the nut arm 37.

As described above, according to the present invention, the bolts 34 which link the adjacent segments S together can be automatically and mechanically tightened. Especially the arms 36 and 37 have the bolt-engagement hole 64 and the nut socket 40, respectively, at their lower end portions and the motor 66 for driving the nut socket 40 and the cylinders 59 and 60 which cause the arms 36 and 37 to move toward or away from each other are mounted adjacent to the upper portions of the arms 36 and 37 such that these driving systems will not interfere with the segments S. As a consequence, bolts can be automatically tightened even at a narrow place where it is very difficult to tighten the bolts by hand.

So far the automatic bolt-tightening device in accordance with the present invention has been described as being used to link the adjacent segments together, but it is to be understood that the present invention may equally applied to automatically tighten bolts in a narrow space so as to link any parts together. Furthermore it is to be understood that the base or root balancer 12 and the end balancer 17 may be incorporated into the second embodiment as shown in FIGS. 8 and 9.

The effects, features and advantages of the shield tunneling machine in accordance with the present invention may be summarized as follows:

(1) The base balancer is mounted on the lifting beam so that the base balancer can be movable in the axial direction and the end balancer which holds a segment is joined to the base balancer through the ball-and-socket joint so that the end balancer may swing about the ball-and-socket joint in the circumferential and axial directions when the posture-adjustment cylinder is actuated. As a result, the end balancer can suitably control the posture of the segment and the erection and assembly of segments can be accomplished easily and quickly and the tunnel construction costs can be reduced.

(2) Furthermore, the end balancer is provided with the bolt-tightening devices so that the adjacent segments can be automatically linked together while the posture of the segment held by the end balancer is suitably controlled. Therefore, the erection and assembly of segments can be accomplished easily and quickly and the number of workers can be decreased and the safety can be improved.

(3) Because of the construction described above, when a sensor for detecting the position of a segment which has been already erected is provided, the automatic segment erection and assembly becomes possible.

(4) The guide rollers are provided so that a segment which is supplied from the tail of the shield can be guided toward the segment holding member smoothly and quickly. As a result, the erection and assembly of segments can be accomplished quickly.

(5) The construction of the shield tunneling machine of the present invention is simple so that the tunneling machines can be fabricated easily and the present invention can be easily applied to the existing erector.

What is claimed is:

1. In a shield tunneling machine comprising a revolving ring adapted to rotate along an inner wall surface of a shield frame, thereby moving a segment to the inner surface of a tunnel, and a lifting beam adapted to move radially of said revolving ring, the improvement comprising a base balancer mounted on said lifting beam and movable in an axial direction of said shield frame, an end balancer mounted on said base balancer through a ball-and-socket joint, posture-adjustment cylinders for causing said end balancer to swing about said ball-and-socket joint, and a segment holding member extending outwardly of said end balancer.

2. A machine according to claim 1 wherein said end balancer is provided with bolt-tightening devices for linking the segment held by said end balancer to a segment which has been already erected.

3. A machine according of claim 2 wherein in order to threadably engage a nut which is rotatably mounted on a flange of one of adjacent segments to be linked together with a bolt which is disposed to be rotatable about its axis at a flange of the other segment, said bolt-tightening device comprises a pair of engaging arms whose one end portions are inserted into flange holes and which are movable toward or away from each other, an engaging hole on an end portion of one of said arms for engagement with said bolt, a nut socket on an end portion of the other arm adapted to engage with said nut for rotation thereof, driving means for rotating said nut socket, and means for causing said pair of engaging arms to selectively move toward and away from each other.

* * * * *